US005203115A

United States Patent [19]

Marinoni

[11] Patent Number: 5,203,115

[45] Date of Patent: Apr. 20, 1993

[54] DOOR ALIGNING DEVICE

[75] Inventor: Mario Marinoni, Magenta, Italy

[73] Assignee: Societa Italiana Progetti S.r.l., Milan, Italy

[21] Appl. No.: 845,935

[22] Filed: Mar. 6, 1992

[30] Foreign Application Priority Data

Mar. 7, 1991 [DE] Fed. Rep. of Germany ..... 4107327

[51] Int. Cl.[5] ..... F05D 7/08

[52] U.S. Cl. ..... 49/388; 16/236; 16/240

[58] Field of Search ..... 49/381, 388, 398; 16/236, 240, 379

[56] References Cited

U.S. PATENT DOCUMENTS

| | | | |
|---|---|---|---|
| 2,316,528 | 4/1943 | Miles | 49/388 |
| 2,317,931 | 4/1943 | Miller et al. | 49/388 |
| 2,820,243 | 1/1958 | Gibbons | 16/236 |
| 2,923,036 | 2/1960 | Beyrle | 49/388 |
| 3,115,665 | 12/1963 | Cecala | 49/398 |
| 3,299,576 | 1/1967 | Bobrowski | 16/379 |
| 4,313,239 | 2/1982 | Tsuneki | 16/236 |
| 4,646,472 | 3/1987 | Sugawara | 49/388 |
| 4,698,877 | 10/1987 | Lautenschläger, Jr. | 16/236 |
| 4,785,499 | 11/1988 | Giuffrida et al. | 49/381 |
| 4,977,642 | 12/1990 | Marinoni | 16/379 |

FOREIGN PATENT DOCUMENTS

| | | | |
|---|---|---|---|
| 2730558 | 1/1978 | Fed. Rep. of Germany | 16/236 |
| 1152464 | 2/1958 | France | 16/379 |
| 1301162 | 9/1960 | France | 49/381 |
| 683637 | 12/1952 | United Kingdom | 49/388 |

*Primary Examiner*—Michael F. Trettel
*Assistant Examiner*—Michael J. Milano
*Attorney, Agent, or Firm*—Foley & Lardner

[57] ABSTRACT

The invention relates to a door having at least one wing which can be swivelled about a lower hinge axis of a bearing device of a lower door rail, and about an upper hinge axis of a bearing device of an upper door rail relative to a door closer disposed within an upper tubular door frame. The upper hinge axis is defined by an adjustable first hinge part which is disposed on the outside of an upper wing frame section and which is capable of swivelling in a limited fashion about an essentially vertical alignment axis, and by a second hinge part which is essentially horizontally displaceable 1) in a limited fashion on the first hinge part and 2) essentially parallel to the plane of the wing. The first and second hinge parts are capable of being fixed in place.

8 Claims, 4 Drawing Sheets

DOOR ALIGNING DEVICE

BACKGROUND OF THE INVENTION

1. Field of the Invention

The invention relates to an all glass door having at least one wing which can be swivelled about a lower hinge axis of a bearing of a lower door rail, and about an upper hinge axis of a bearing of an upper door rail, with respect to a door closer mounted in an upper tubular frame. More particularly, the invention relates to a door having either a single wing or two wings, wherein at least one door can be aligned.

2. Description of the Related Art

In the past, it has always been difficult to align doors, particularly once the door was closed. Accordingly, it was often the case that upon hanging a door, its alignment was improper. This would often require the removal and rehanging of the door in order to obtain its proper alignment.

SUMMARY OF THE INVENTION

An object of the invention is to provide an all glass door whereby at least one wing can be aligned in its closed state, thereby making the aligning process substantially easier than prior art devices since the door frame and possibly an opposing wing can be used as an alignment gauge.

The above objective is met by providing a door having a bearing device including an upper hinge axis which is defined by an adjustable first hinge part which is connected to the outside of an upper wing frame section and which is capable of swivelling in a limited fashion about an essentially vertical alignment axis, and a second hinge part which is connected to the first hinge part and which is essentially horizontally displaceable in a limited fashion relative to the first hinge part and also essentially parallel to a top surface of the wing.

The alignment is made particularly easier if the first and second hinge parts can be adjusted and horizontally displaced, respectively, from a common side of the wing.

For reasons of structural simplicity, and in order to save space, it is preferred that the bearing device have a band which is coupled to the first hinge part by a pin-hole joint and which is mounted on the outside of the wing frame section. The band has a pair of cheeks which are located on opposite sides of a section of the band which is opposite to the vertical axis. The bearing device also has a grub screw which is received in a threaded portion of the first hinge part thereby allowing the first hinge part to be swivelled in a limited fashion and subsequently fixed in place from one side of the wing. The cheeks limit the axial displacement of the grub screw.

Moreover, in order to be able to secure the first hinge part in a frictionally engaged fashion, the first hinge part has an essentially vertical opening in a segment which is disposed opposite to the swivel axis. The opening receives a cap screw which passes therethrough and which is screwed into the wing frame section. The diameter of the cap screw is smaller than the width of the opening and the cap screw extends in a direction which is transverse to the top surface of the wing.

Additionally, the second hinge part is preferably attached to the first hinge part in a horizontally displaceable limited fashion by mounting it on the first hinge part at points on both sides of the vertical alignment axis, by means of cap screws which pass through essentially horizontal slots formed in the second hinge part.

Moreover, in order to prevent the hinge parts from being visible from the outside, they are preferably covered on both sides by cover strips which can be clipped onto the wing frame section.

While the preferred bearing device preferably defines an upper hinge axis of a wing, it can also define a lower hinge axis of the wing, or both upper and lower hinge axes. Usually, it is sufficient if the bearing device defining the upper hinge axis and the lower hinge axis is defined only by a displaceable second hinge part which can be fixed in place from one side of the wing.

BRIEF DESCRIPTION OF THE DRAWINGS

Other objects, features and advantages of the present invention will become apparent from the following detailed description and accompanying drawings wherein.

DETAILED DESCRIPTION OF THE PREFERRED EMBODIMENTS

Figure 1:
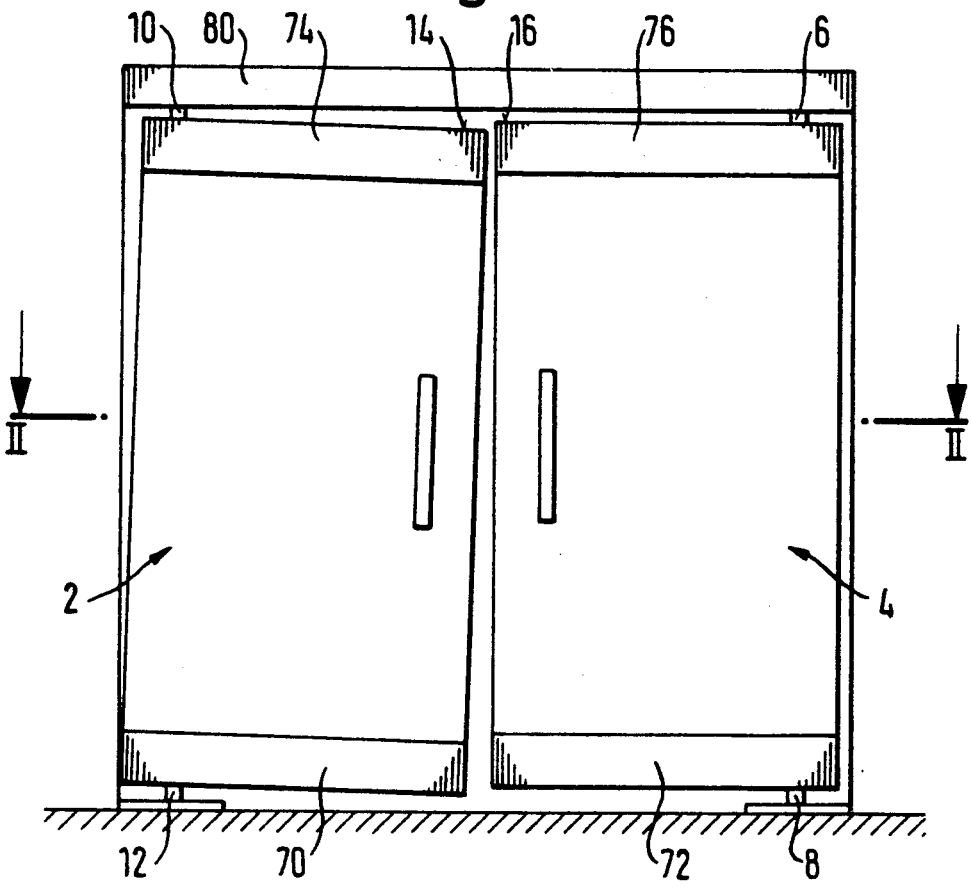
FIG. 1 is a front elevational view of a two-wing door, the right-hand wing of which is already aligned, the left-hand wing of which still requires alignment.
Figure 2:
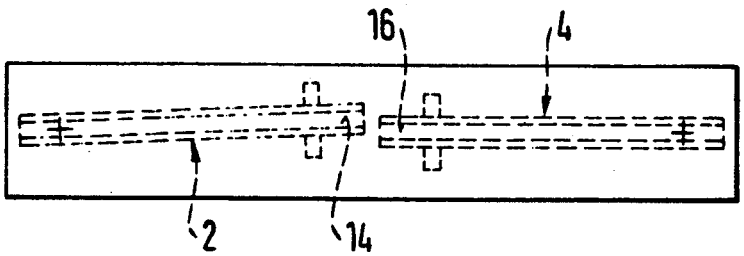
FIG. 2 is a section taken along the line II—II of FIG. 1, from which it can be seen that the left-hand wing still needs to be aligned in its closed state with respect to the aligned right-hand wing.
Figure 3:
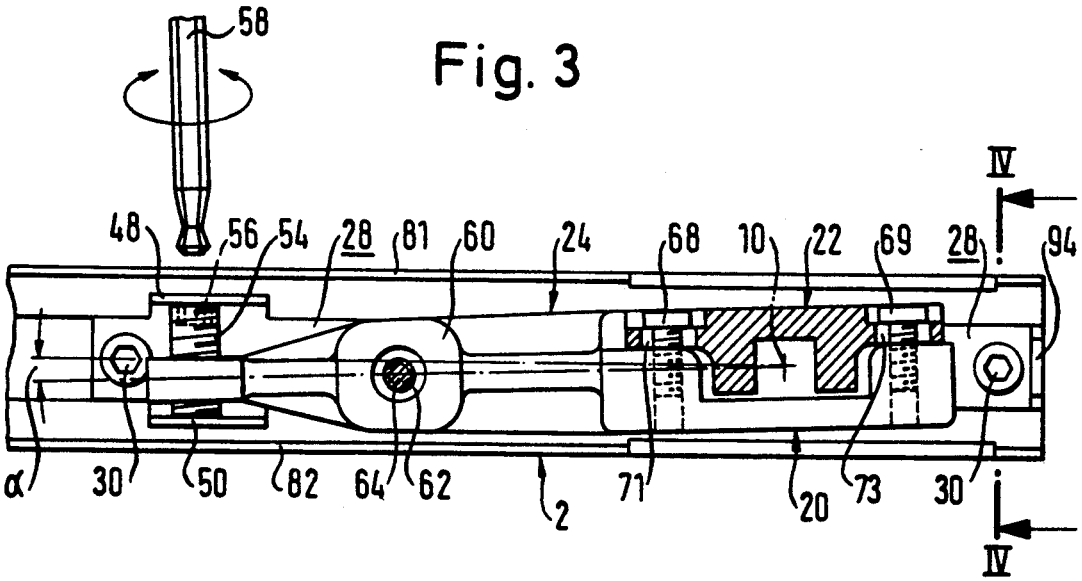
FIG. 3 is a top plan view of a device for aligning a wing.
Figure 4:
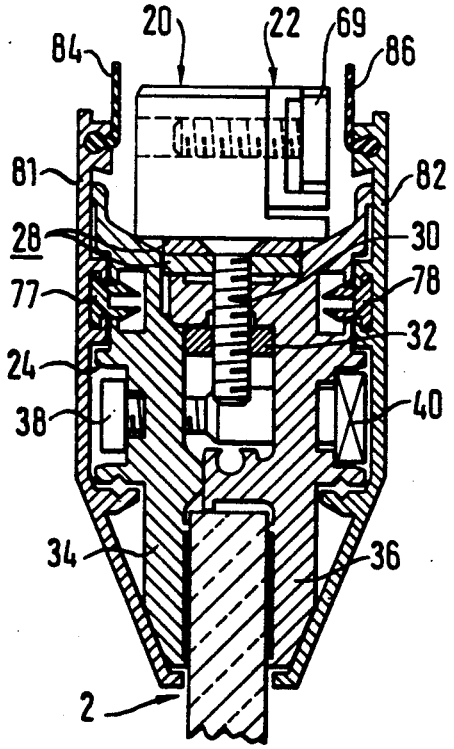
FIG. 4 is a sectional view taken along line IV—IV in FIG. 3.
Figure 5:
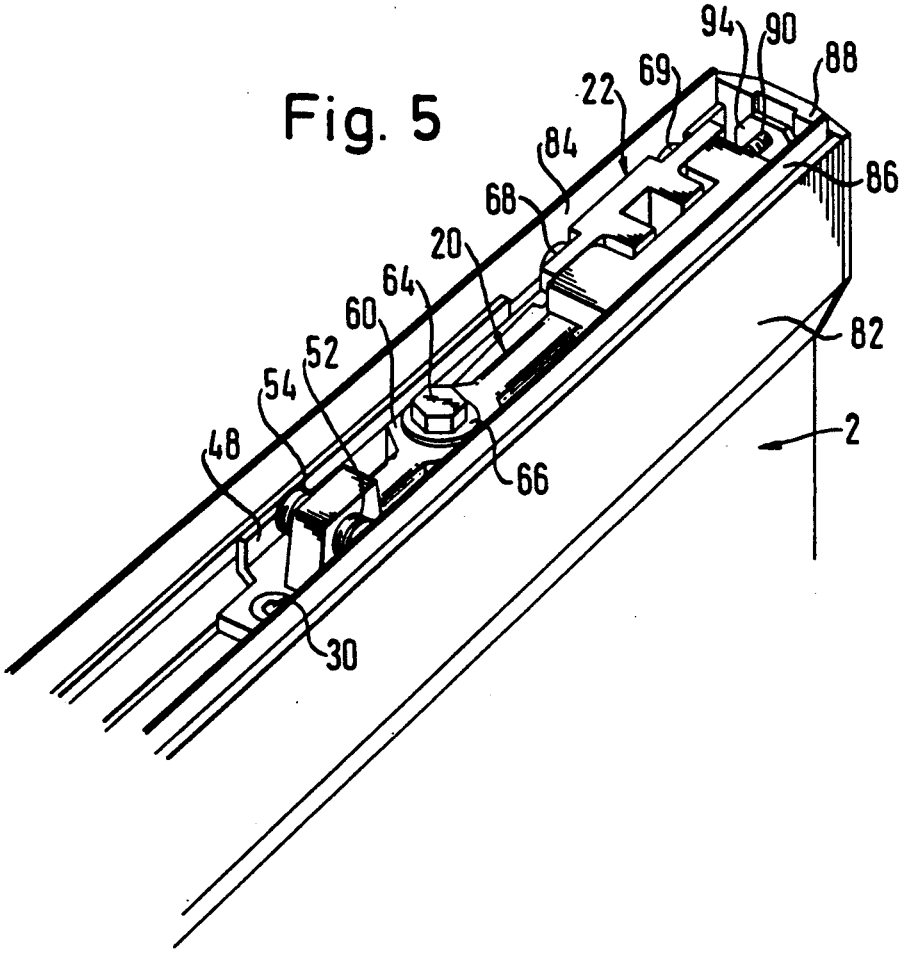
FIG. 5 is an oblique perspective view of the device.
Figure 6:
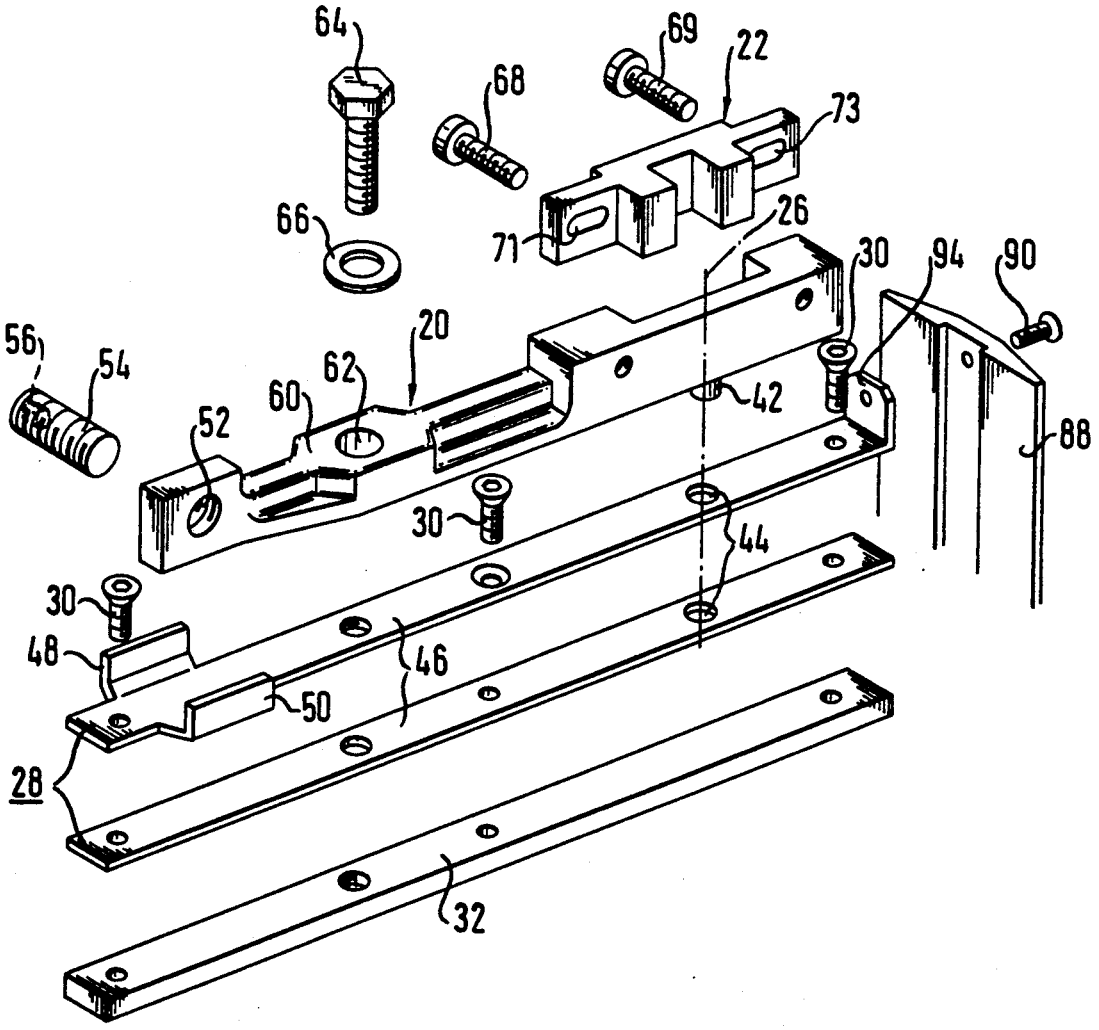
FIG. 6 is an exploded view of the device.

FIG. 1 shows an all glass door with a left-hand wing 2 and a right-hand wing 4. The right-hand wing 4 is aligned with respect to the axis 6 of upper hinge 7 and the axis 8 of lower hinge 9. The axis 10 of upper hinge 7 and the axis 12 of lower hinge 13 of the wing 2 are not aligned. Instead, the top surface 14 of the wing 2 is inclined with respect to the wing 4, and in addition, as can be seen from FIG. 2, is not flush with the top surface 16 of the wing 4.

The wings 2, 4 each have bearing elements disposed in a lower door rail 70, 72, respectively, and bearing elements in an upper door rail 74, 76, respectively. Each wing 2, 4 is assigned a door closer which is arranged in an upper tubular frame 80.

In order to simplify the description, only the construction of the wing 2 is herein described, however, the construction of wing 4 is identical.

In order to permit alignment, as can be seen from FIGS. 3–6, the upper hinge axis 10 is defined by first and second hinge parts 20, 22. Hinge part 20 is capable of being swivelled in a limited fashion on an essentially horizontal plane outside of a wing frame section 24, about an essentially vertical alignment axis 26. Hinge part 20 can be fixed in place from one side of the wing 2. Hinge part 22 is displaceable in a horizontally limited fashion on the aforesaid hinge part 20, and can be fixed in place from the same side of the wing 2 as hinge part 20. Moreover, hinge part 22 is horizontally displaceable in an essential horizontal fashion relative to the top surface 14.

For this purpose, a double band 28 is mounted on the outside of the wing frame section 24 by means of vertical countersunk cap screws 30 which engage in a corresponding bearing band 32 in the wing frame section 24. The wing frame section 24 has, in a manner known per se, two cheeks 34, 36 which extend around the wing 2 and which are held together by cap screws 38 and sleeve nuts 40. Hinge part 20 has a pin 42 disposed thereon that couples it to the double band 28 by engaging with a continuous hole 44 formed in the double band 28. Cheeks 48, 50 are formed on a section 46 of the double band 28. The cheeks 48, 50 limit the axial movement of a grub screw 54 which penetrates a threaded portion 52 that is formed in one end of hinge part 20. The grub screw 54 has, at one end, a countersunk portion 56 which is provided with anti-rotation faces which engage with a tool 58 for rotating the grub screw 54 when the tool is inserted into the countersunk portion 56. By rotating the grub screw 54, in either the clockwise or counterclockwise direction, the hinge part 20 can be swivelled about its alignment axis 26 through an angle $\alpha$ of approximately $\pm 3°$. When rotation of the grub screw 54 ceases, the hinge part 20 is fixed in place.

The hinge part 20 has, in a section 60 which is located opposite from hinge axis 10, an essentially vertical hole 62 through which a cap screw 64 passes. The cap screw 64 is screwed into the wing frame section 24 with the interposition of an elastic packing ring 66 between the top end of the cap screw 64 and the hinge part 20. The diameter of the cap screw 64 is smaller than the diameter of the hole 62. Additionally, cap screw 64 extends in a direction which is transverse to top surface 14.

The second hinge part 22 is mounted on the first hinge part 20, at points that are on both sides of the hinge axis 10 and on both sides of the alignment axis 26, by means of cap screws 68, 69. The cap screws 68, 69 penetrate through horizontal elongate holes 71, 73 formed in hinge part 22, respectively, and into the second hinge part 20.

The hinge parts 20, 22 are covered on both sides by cover strips 81, 82 which can be clipped into the wing frame section 24 by means of plastic projections respectively 77, 78. On the free edges of cover strips 81, 82, there are provided flexible sealing strips 84, 86 respectively.

The free end side of the wing frame section 24 is covered by a cladding 88. Screws 90, 92 (92 not shown) are screwed through cladding 88 and into a folded edge 94 of the double band 28 and the wing frame section 24, respectively, in order to mount the cladding 88 to cover the wing frame section 24.

In operation, it can be easily seen that in order to vertically align the door, the second hinge part 22 can be horizontally displaced thereby changing the location of the hinge axis in order to raise or lower the free end of the wing and to align the top and bottom hinge axes. Correspondingly, by rotating the grub screw in a clockwise or counterclockwise position, the first hinge part 20 will swivel about pin 42 thereby adjusting the position of the door along a plane which is horizontal to upper tubular frame 80.

It is to be understood that the foregoing detailed description, while indicating preferred embodiments of the present invention, are given by way of illustration and not limitation. Many changes and modifications within the scope of the present invention may be made without departing from the spirit thereof, and the invention includes all such modifications.

What is claimed is:

1. A door comprising:

at least one wing;

a lower door rail being connected to said wing and having a lower bearing device, wherein said lower bearing device has a lower hinge axis about which said wing can be swivelled relative to a door closer in an upper tubular door frame;

an upper hinge having an upper hinge axis about which said wing can be swivelled relative to said door closer;

an upper door rail being connected to said wing, and having an upper bearing device;

wherein, said upper bearing device includes

A) an adjustable first hinge part which is capable 1) of swivelling on an outside surface of said upper wing frame section in a limited fashion about an essentially vertical alignment axis and 2) of being fixed in place, and B) a second hinge part which is connected to said first hinge part and which is essentially horizontally displaceable 1) in a limited fashion relative to said first hinge part, and 2) essentially parallel to a top surface of said wing, and which is capable of being fixed in place, and wherein said upper hinge is positively disposed between said first and second hinge parts such that the location of said upper hinge axis is changed when said second hinge part is displaced horizontally relative to said first hinge part.

2. A door as recited in claim 1, wherein said upper bearing device further comprises a band which is coupled to said first hinge part by a pin-hole joint, and a grub screw, wherein said band is mounted to the outside surface of said upper wing frame section and includes 1) a section which is opposite to said vertical alignment axis and 2) a pair of cheeks disposed on opposite sides of said section, and wherein said first hinge part has a threaded portion disposed therein which receives said grub screw, and said cheeks limit an axial displacement of said grub screw.

3. A door as recited in claim 1, wherein said first hinge part and said second hinge part can be fixed in place from a common side of said wing.

4. A door as recited in claim 1, wherein said upper bearing device further comprises a cap screw, said first hinge part has a section which is disposed opposite said vertical alignment axis and has an essentially vertical opening disposed therein, said cap screw passes through said vertical opening and is screwed into said upper wing frame section, and the cap screw extends in a direction which is transverse to a top surface of said wing and is smaller than the width of said vertical opening.

5. A door as recited in claim 1, wherein said upper bearing device further comprises first and second cap screws, and said second hinge part has first and second essentially horizontal slots disposed therein such that said first and second cap screws pass through said first and second essentially horizontal slots, respectively, and into said first hinge part thereby mounting said second hinge part to said first hinge part on both sides of said vertical alignment axis.

6. A door as recited in claim 1, further comprising first and second cover strips each of which is clipped onto said upper wing frame section thereby covering first and second sides of said first hinge part and first and second sides of said second hinge part.

7. A door comprising:

a wing having upper and lower hinge axes about which said wing is rotatable relative to an upper frame member of a door frame, and an upper wing frame section;

a first hinge part mounted on said upper wing frame section which is adjustable to pivot in a limited manner around an essential vertical aligning axis and which can be fixed in place, said vertical aligning axis being stationary relative to said wing;

a second hinge being part horizontally displaceable relative to said first hinge part and a top surface of said wing, and capable of being fixed in place;

wherein said upper hinge axis is received and positively contained in a space defined between said first and second hinge parts such that the location of said space and said upper hinge axis, relative to said top surface of said wing, is changed when said second hinge part is horizontally displaced relative to said first hinge part;

whereby an adjustment of said first hinge part aligns said wing in a first direction and horizontal displacement of said second hinge part relative to said first hinge part aligns said wing in a second direction.

8. A door as recited in claim 7, wherein said first hinge part is mounted on an outer side of said upper wing frame section.

* * * * *